US011375802B2

(12) United States Patent
Jungnickel

(10) Patent No.: US 11,375,802 B2
(45) Date of Patent: Jul. 5, 2022

(54) ORAL CARE IMPLEMENT

(71) Applicant: The Gillette Company LLC, Boston, MA (US)

(72) Inventor: Uwe Jungnickel, Königstein (DE)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/225,688

(22) Filed: Dec. 19, 2018

(65) Prior Publication Data

US 2019/0200742 A1 Jul. 4, 2019

(30) Foreign Application Priority Data

Dec. 20, 2017 (EP) ..... 17208874

(51) Int. Cl.

| | |
|---|---|
| ***A46B 5/02*** | (2006.01) |
| ***A46B 5/00*** | (2006.01) |
| ***A46B 9/04*** | (2006.01) |
| ***A46B 17/02*** | (2006.01) |
| ***A46B 15/00*** | (2006.01) |

(52) U.S. Cl.

CPC ..... *A46B 5/026* (2013.01); *A46B 5/0095* (2013.01); *A46B 5/02* (2013.01); *A46B 5/021* (2013.01); *A46B 9/04* (2013.01); *A46B 15/0002* (2013.01); *A46B 17/02* (2013.01); *A46B 9/045* (2013.01); *A46B 2200/1066* (2013.01)

(58) Field of Classification Search

CPC ..... A46B 5/0095; A46B 5/002; A46B 5/02; A46B 7/042; A46B 9/04; A46B 17/02

See application file for complete search history.

(56) References Cited

U.S. PATENT DOCUMENTS

| | | | |
|---|---|---|---|
| 3,927,435 | A | 12/1975 | Moret |
| 4,384,645 | A | 5/1983 | Manfredi |
| 4,811,445 | A | 3/1989 | Lagieski |
| 5,109,563 | A | 5/1992 | Lemon et al. |
| 5,335,389 | A | 8/1994 | Curtis et al. |

(Continued)

FOREIGN PATENT DOCUMENTS

| | | |
|---|---|---|
| CN | 2320102 | 5/1999 |
| CN | 1223834 | 7/1999 |

(Continued)

OTHER PUBLICATIONS

International Search Report with written opinion, dated Feb. 12, 2019; 15 pages.

(Continued)

*Primary Examiner* — Shay Karls
(74) *Attorney, Agent, or Firm* — Vladimir Vitenberg

(57) ABSTRACT

An oral care implement has an overall length extension extending between a proximal end and a distal end, the distal end being opposite the proximal end. The oral care implement comprises a head at the proximal end and a handle, the handle being at least partially made from a material having a density being higher than the density of the material of the head. The oral care implement has a center of gravity located at a distance measured from the distal end, and the ratio of said distance to the overall length extension of the oral care implement is from about 0.30 to about 0.45, preferably from about 0.35 to about 0.42, further preferably from about 0.38 to about 0.41.

16 Claims, 8 Drawing Sheets

(56) References Cited

U.S. PATENT DOCUMENTS 5,361,446 A 11/1994 Rufo
5,369,835 A 12/1994 Clarke
5,875,510 A 3/1999 Lamond et al.
5,956,796 A * 9/1999 Lodato ..... A46B 5/00 15/143.1
6,015,328 A 1/2000 Glaser
6,086,373 A 7/2000 Schiff
6,230,716 B1 5/2001 Minoletti
6,308,367 B1 10/2001 Beals et al.
6,643,886 B2 11/2003 Moskovich
6,671,919 B2 1/2004 Davis
6,871,373 B2 3/2005 Driesen
7,137,166 B1 11/2006 Kraemer
8,387,197 B2 3/2013 Moskovich
8,563,020 B2 10/2013 Uhlmann
8,727,141 B2 5/2014 Akalin
8,931,855 B1 1/2015 Foley et al.
9,049,921 B1 6/2015 Rackston
9,066,579 B2 6/2015 Hess
9,161,544 B2 10/2015 Agrawal et al.
9,168,117 B2 10/2015 Yoshida et al.
9,226,508 B2 1/2016 Uhlmann et al.
9,265,335 B2 2/2016 Foley et al.
9,402,461 B2 8/2016 Brik et al.
9,427,077 B1 8/2016 Zhang
D775,469 S 1/2017 Sikora et al.
9,539,750 B2 1/2017 Gross et al.
9,609,940 B2 4/2017 Corbett
9,642,682 B2 5/2017 Kato
D814,195 S 4/2018 Sikora et al.
10,195,005 B2 2/2019 Wallström et al.
10,667,892 B2 6/2020 Bärtschi et al.
10,792,136 B2 10/2020 May et al.
D901,183 S 11/2020 Jungnickel et al.
D912,988 S 3/2021 Langhammer
D917,298 S 4/2021 Hallein et al.
D926,048 S 7/2021 Hallein et al.
D926,049 S 7/2021 Hallein et al.
D930,990 S 9/2021 Hallein et al.
D931,617 S 9/2021 Hallein et al.
D931,619 S 9/2021 Hallein et al.
D933,368 S 10/2021 Albay et al.
D936,484 S 11/2021 Hallein et al.
2003/0115706 A1 6/2003 Ponzini
2004/0016073 A1 1/2004 Knutson
2004/0060138 A1 4/2004 Pfenniger et al.
2005/0268414 A1 12/2005 Kim
2005/0286967 A1 12/2005 Blauzdys
2006/0086370 A1 4/2006 Omeara
2008/0120795 A1 5/2008 Reinbold
2008/0220235 A1 9/2008 Izumi
2009/0089950 A1* 4/2009 Moskovich ..... A46B 5/02 15/167.1
2010/0115724 A1 5/2010 Huang
2011/0016651 A1 1/2011 Piserchio
2011/0146015 A1 6/2011 Moskovich
2012/0036663 A1 2/2012 Chen
2012/0073072 A1 3/2012 Moskovich et al.
2012/0090117 A1* 4/2012 Akalin ..... A47L 13/512 15/167.1
2012/0198640 A1 8/2012 Jungnickel et al.
2012/0227200 A1* 9/2012 Kraemer ..... A46B 5/007 15/167.1
2012/0301528 A1 11/2012 Uhlmann
2012/0301530 A1 11/2012 Uhlmann
2012/0301531 A1 11/2012 Uhlmann
2012/0301533 A1 11/2012 Uhlmann
2013/0000059 A1 1/2013 Jungnickel et al.
2013/0171225 A1 7/2013 Uhlmann
2013/0291326 A1 11/2013 Mintel
2013/0315972 A1 11/2013 Krasnow et al.
2014/0137349 A1* 5/2014 Newman ..... A46B 9/04 15/143.1
2014/0359957 A1 12/2014 Jungnickel
2014/0359958 A1 12/2014 Jungnickel
2015/0034858 A1* 2/2015 Raman ..... H01L 23/3737 252/74
2015/0143651 A1 5/2015 Foley et al.
2015/0147372 A1 5/2015 Agrawal et al.
2015/0245618 A9 9/2015 Agrawal et al.
2015/0289635 A1 10/2015 Erskine-Smith
2015/0305487 A1 10/2015 Pardo et al.
2015/0351406 A1 12/2015 Wingfield
2016/0135579 A1 5/2016 Tschol et al.
2016/0220014 A1 8/2016 Sprosta
2017/0079418 A1 3/2017 Mintel
2017/0347782 A1 12/2017 Jimenez et al.
2017/0347786 A1 12/2017 Jimenez et al.
2017/0367469 A1 12/2017 Jimenez et al.
2018/0016408 A1 1/2018 Stibor
2018/0055206 A1 3/2018 Nelson et al.
2018/0311023 A1 11/2018 Yao
2019/0000223 A1 1/2019 Alinski
2019/0069978 A1 3/2019 Katano et al.
2019/0117356 A1 4/2019 Bärtschi et al.
2019/0200740 A1 7/2019 Jungnickel
2019/0200743 A1 7/2019 Jungnickel
2019/0200748 A1 7/2019 Görich
2019/0246779 A1 8/2019 Jungnickel et al.
2019/0246780 A1 8/2019 Jungnickel et al.
2019/0246781 A1 8/2019 Jungnickel et al.
2019/0248049 A1 8/2019 Jungnickel et al.
2020/0022793 A1 1/2020 Scherrer et al.
2020/0077778 A1 3/2020 Jungnickel
2020/0121069 A1 4/2020 Jungnickel
2020/0305588 A1 10/2020 Jungnickel
2021/0120948 A1 4/2021 Gorich et al.
2021/0128286 A1 5/2021 Jungnickel et al.

FOREIGN PATENT DOCUMENTS

CN 1229341 A 9/1999
CN 1229622 9/1999
CN 2346277 11/1999
CN 1241123 A 1/2000
CN 201036392 3/2008
CN 201185740 1/2009
CN 201563874 U 9/2010
CN 201630520 11/2010
CN 201675294 12/2010
CN 201861064 6/2011
CN 201861068 6/2011
CN 202035662 11/2011
CN 202269590 U 6/2012
CN 202286879 7/2012
CN 202476817 10/2012
CN 102907880 2/2013
CN 102948997 3/2013
CN 103829559 3/2013
CN 202820100 3/2013
CN 202941615 5/2013
CN 202980745 6/2013
CN 103844575 11/2014
CN 105054571 11/2015
CN 205082879 3/2016
CN 105534002 5/2016
CN 105750734 7/2016
CN 105818322 8/2016
CN 205568222 9/2016
CN 206714397 12/2017
CN 207055161 3/2018
CN 111713845 A 9/2020
DE 3241118 A1 8/1984
DE 202005002964 7/2005
DE 202006019788 8/2007
DE 102006051649 5/2008
DE 202015002964 U1 8/2015
EP 0100975 A2 2/1984
EP 0481553 A1 4/1992
EP 2117395 A2 11/2009
EP 2218559 A1 8/2010
EP 3090646 11/2016
EP 3381404 A1 10/2018

(56) References Cited

FOREIGN PATENT DOCUMENTS

| | | | |
|---|---|---|---|
| EP | 3501333 | A1 | 6/2019 |
| FR | 2835176 | | 8/2003 |
| GB | 766486 | | 1/1957 |
| GB | 2493409 | | 2/2013 |
| JP | 61020509 | | 1/1986 |
| JP | S63284262 | | 11/1988 |
| JP | H0669408 | | 3/1994 |
| JP | 2561978 | | 12/1996 |
| JP | 2619825 | | 6/1997 |
| JP | 2002512540 | | 4/2002 |
| JP | 2003009951 | | 1/2003 |
| JP | 2003245132 | | 9/2003 |
| JP | 2004089471 | | 3/2004 |
| JP | 2005053973 | | 3/2005 |
| JP | 4076405 | | 2/2008 |
| JP | 2009011621 | | 1/2009 |
| JP | 2011045621 | | 3/2011 |
| JP | 2011087747 | | 5/2011 |
| JP | 3213325 | | 11/2017 |
| KR | 20070013844 | | 1/2007 |
| KR | 20090030829 | | 3/2009 |
| KR | 101142611 | | 5/2012 |
| KR | 101339558 | | 12/2013 |
| KR | 200473116 | | 6/2014 |
| KR | 20150057308 | | 5/2015 |
| KR | 20150105813 | | 9/2015 |
| KR | 101591299 | | 2/2016 |
| KR | 20160125725 | | 11/2016 |
| KR | 20170062779 | | 6/2017 |
| KR | 200486759 | Y1 | 6/2018 |
| RU | 2141238 | | 11/1999 |
| TW | 431151 | | 1/2001 |
| WO | WO9510959 | | 4/1995 |
| WO | WO9838889 | | 9/1998 |
| WO | 9844823 | A2 | 10/1998 |
| WO | 2005002826 | A1 | 1/2005 |
| WO | WO2005030002 | | 4/2005 |
| WO | WO200641658 | | 4/2006 |
| WO | 2008098107 | A2 | 8/2008 |
| WO | 2009045982 | A1 | 4/2009 |
| WO | 2012126126 | | 9/2012 |
| WO | 2012144328 | | 10/2012 |
| WO | 2013076904 | | 5/2013 |
| WO | 2013101300 | A1 | 7/2013 |
| WO | 2013158741 | | 10/2013 |
| WO | 2014193621 | | 12/2014 |
| WO | 2018025751 | | 2/2018 |
| WO | 2019072925 | A1 | 4/2019 |
| WO | 2019157787 | A1 | 8/2019 |

OTHER PUBLICATIONS

All Office Actions, U.S. Appl. No. 16/272,392.
All Office Actions, U.S. Appl. No. 16/272,422.
All Office Actions, U.S. Appl. No. 16/272,872.
All Office Actions, U.S. Appl. No. 16/272,943.
All Office Actions; U.S. Appl. No. 16/225,592.
All Office Actions; U.S. Appl. No. 16/225,809.
All Office Actions; U.S. Patent Application U.S. Appl. No. 16/225,509.
Extended European Search Report and Search Opinion; Application No. 17208870.0; dated Jun. 26, 2018; 8 pages.
Extended European Search Report and Search Opinion; Application No. 17208874.2; dated Feb. 9, 2018; 9 pages.
Extended European Search Report and Search Opinion; Application No. 17208951.8; dated Feb. 19, 2018 ; 6 pages.
Extended European Search Report and Search Opinion; Application No. 17208954.2; dated Feb. 15, 2018; 8 pages.
Extended European Search Report and Search Opinion; Application No. 18155967.5; dated Jul. 20, 2018, 7 pages.
Extended European Search Report and Search Opinion; Application No. 18156005.3; dated Jul. 12, 2018, 8 pages.
Extended European Search Report and Search Opinion; Application No. 18156035.0; dated Aug. 1, 2018, 7 pages.
Extended European Search Report and Search Opinion; Application No. 18156000.4; dated Jul. 20, 2018, 8 pages.
International Search Report and Written Opinion; Application Ser. No. PCT/US2018/065317; dated Jan. 29, 2019, 13 pages.
International Search Report and Written Opinion; Application Ser. No. PCT/US2018/065395; dated Mar. 11, 2019, 11 pages.
International Search Report and Written Opinion; Application Ser. No. PCT/US2018/1065600; dated Feb. 20, 2019, 13 pages.
International Search Report and Written Opinion; Application Ser. No. PCT/US2019/016212; dated May 24, 2019, 10 pages.
International Search Report and Written Opinion; Application Ser. No. PCT/US2019/016214; dated May 29, 2019, 10 pages.
International Search Report and Written Opinion; Application Ser. No. PCT/US2019/016215; dated May 24, 2019, 11 pages.
International Search Report and Written Opinion; Application Ser. No. PCT/US2019/016216; dated Apr. 25, 2019, 8 pages.
U.S. Appl. No. 17/077,639, filed on Oct. 22, 2020, to GOERICH Gerald et al.
U.S. Appl. No. 29/746,709, filed Aug. 17, 2020, Christine Hallein et al.
U.S. Appl. No. 29/659,068, filed Aug. 6, 2020, Christine Hallein et al.
U.S. Appl. No. 29/787.707, filed Jun. 8, 2021, Uwe Jungnickel et al.
U.S. Appl. No. 29/746,718, filed Aug. 17, 2020, Dominik Langhammer.
U.S. Appl. No. 29/681,302, filed Feb. 25, 2019, Christine Hallein et al.
U.S. Appl. No. 29/757,497, filed Nov. 6, 2020, Christine Hallein et al.
U.S. Appl. No. 29/755,910, filed Oct. 23, 2020, Christine Hallein et al.
U.S. Appl. No. 29/757,499, filed Nov. 6, 2020, Christine Hallein et al.
U.S. Appl. No. 29/761,083, filed Dec. 7, 2020, Christine Hallein et al.
U.S. Appl. No. 29/761,085, filed Dec. 7, 2020, Christine Hallein et al.
U.S. Appl. No. 29/761,086, filed Dec. 7, 2020, Christine Hallein et al.
U.S. Appl. No. 29/761,090, filed Dec. 7, 2020, Christine Hallein et al.
U.S. Appl. No. 29/752,903, filed Sep. 29, 2020, Uwe Jungnickel et al.
U.S. Appl. No. 29/752,912, filed Sep. 29, 2020, Uwe Jungnickel et al.
All Office Actions, U.S. Appl. No. 16/551,307.
All Office Actions, U.S. Appl. No. 16/551,399.
All Office Actions, U.S. Appl. No. 16/829,585.
All Office Actions, U.S. Appl. No. 17/077,639.
All Office Actions, U.S. Appl. No. 17/090,980.
All Office Actions, U.S. Appl. No. 17/155,208.
All Office Actions, U.S. Appl. No. 17/218,573.
All Office Actions, U.S. Appl. No. 17/218,742.
All Office Actions, U.S. Appl. No. 17/219,989.
All Office Actions, U.S. Appl. No. 17/225,259.
All Office Actions, U.S. Appl. No. 17/225,283.
All Office Actions, U.S. Appl. No. 17/225,296.
All Office Actions, U.S. Appl. No. 17/225,411.
U.S. Appl. No. 17/155,208, filed on Jan. 22, 2021, to first inventor et. al.
U.S. Appl. No. 17/218,573, filed on Mar. 31, 2021, to first inventor et. al.
U.S. Appl. No. 17/218,742, filed on Mar. 31, 2021, to first inventor et. al.
U.S. Appl. No. 17/219,989, filed on Apr. 1, 2021, to first inventor et. al.
U.S. Appl. No. 17/225,259, filed on Apr. 8, 2021, to first inventor et. al.
U.S. Appl. No. 17/225,283, filed on Apr. 8, 2021, to first inventor et. al.
U.S. Appl. No. 17/225,296, filed on Apr. 8, 2021, to first inventor et. al.

(56) References Cited

OTHER PUBLICATIONS

U.S. Appl. No. 17/225,411, filed on Apr. 8, 2021, to first inventor et. al.
All Office Actions, U.S. Appl. No. 17/354,027.
U.S. Appl. No. 17/354,027, filed on Jun. 22, 2021, to first inventor et. al.
U.S. Appl. No. 29/762,793, filed Dec. 18, 2020, Uwe Jungnickel et al.
U.S. Appl. No. 29/787,712, filed Jun. 8, 2021, Uwe Jungnickel et al.
U.S. Appl. No. 29/699,695, filed Jul. 29, 2019, Niclas Altmann et al.
U.S. Appl. No. 29/743,560, filed Jul. 22, 2020, Devran Albay et al.
U.S. Appl. No. 29/758,268, filed Nov. 13, 2020, Devran Albay et al.
U.S. Appl. No. 29/758,249, filed Nov. 13, 2020, Devran Albay et al.
U.S. Appl. No. 29/758,251, filed Nov. 13, 2020, Devran Albay et al.
U.S. Appl. No. 29/758,276, filed Nov. 13, 2020, Devran Albay et al.
U.S. Appl. No. 29/758,274, filed Nov. 13, 2020, Devran Albay et al.
U.S. Appl. No. 29/786,732, filed Jun. 2, 2021, Devran Albay et al.
U.S. Appl. No. 29/786,746, filed Jun. 2, 2021, Devran Albay et al.
U.S. Appl. No. 29/782,323, filed May 6, 2021, Christine Hallein et al.
All Office Actions; U.S. Appl. No. 17/462,089, filed on Aug. 31, 2021.
U.S. Appl. No. 17/462,089, filed on Oct. 31, 2021, to first inventor et. al.
All Office Actions; U.S. Appl. No. 17/511,103, filed on Oct. 26, 2021.
All Office Actions; U.S. Appl. No. 17/517,928, filed on Nov. 3, 2021.
All Office Actions; U.S. Appl. No. 17/517,937, filed on Nov. 3, 2021.
All Office Actions; U.S. Appl. No. 17/517,957, filed on Nov. 3, 2021.
All Office Actions; U.S. Appl. No. 17/517,975, filed on Nov. 3, 2021.
All Office Actions; U.S. Appl. No. 17/517,990, filed on Nov. 3, 2021.
All Office Actions; U.S. Appl. No. 17/517,999, filed on Nov. 3, 2021.
All Office Actions; U.S. Appl. No. 17/518,009, filed on Nov. 3, 2021.
U.S. Appl. No. 17/511,103, filed on Oct. 26, 2021, to first inventor et. al.
U.S. Appl. No. 17/517,928, filed on Nov. 3, 2021, to first inventor et. al.
U.S. Appl. No. 17/517,937, filed on Nov. 3, 2021, to first inventor et. al.
U.S. Appl. No. 17/517,957, filed on Nov. 3, 2021, to first inventor et. al.
U.S. Appl. No. 17/517,975, filed on Nov. 3, 2021, to first inventor et. al.
U.S. Appl. No. 17/517,990, filed on Nov. 3, 2021, to first inventor et. al.
U.S. Unpublished U.S. Appl. No. 17/517,999, filed on Nov. 3, 2021, to first inventor et. al.
U.S. Unpublished U.S. Appl. No. 17/518,009, filed on Nov. 3, 2021, to first inventor et. al.

* cited by examiner

ORAL CARE IMPLEMENT

FIELD OF THE INVENTION

The present disclosure is concerned with an oral care implement comprising a head and a handle, wherein the head and the handle are made from materials having different densities. The present disclosure is further concerned with a method for manufacturing such oral care implement, and a kit comprising such oral care implement and a holder for holding the implement.

BACKGROUND OF THE INVENTION

Heads and handles for oral care implements, like manual toothbrushes, are well known in the art. Generally, tufts of bristles for cleaning teeth are attached to a bristle carrier or mounting surface of the brush head intended for insertion into a user's oral cavity. The handle is usually attached to the head, which handle is held by a user during brushing. Usually, manual toothbrushes are made of relatively light materials, e.g. polypropylene, optionally in combination with thermoplastic elastomers. Typically, these thermoplastic elastomers form gripping members on the handle of the toothbrush, e.g. a thumb rest improving gripping properties. However, due to the lightweight handle, the center of gravity of such manual toothbrushes is relatively close the toothbrush head, in particular when the head is loaded with toothpaste. If the center of gravity is relatively close to the toothbrush head, the toothbrush gets head loaded and can easily tip over once toothpaste is applied onto the brush head. Toothpaste may soil the surface onto which the brush has been placed. To prevent the loaded toothbrush from tipping over, additional geometrical structures, like roll stops/support structures are necessary. Toothbrushes are known having such structures in the form of edges attached to the head. However, such additional edges are uncomfortable in the mouth during brushing.

Further, brushes comprising relatively light handles, in particular handles being made of common plastic materials, e.g. polypropylene, provide low product quality perception during use of the brushes.

Additionally, in order to clean teeth effectively, appropriate maneuverability and good handling properties of the overall toothbrush have to be provided, which properties, inter alia, depend on the bending stiffness of the handle and the brush head. Usually handles of toothbrushes have the shape of a linear rod to be handled and manipulated by a user as needed. It has been seen in the past that manual toothbrushes with lightweight handles, e.g. made of polypropylene, are neither comfortable to handle nor easy to maneuver in the oral care cavity. Further, bending stiffness of such handles is relatively low. They tend to flex away easily and the relatively low bending stiffness results in reduced plaque removal efficiency on teeth surfaces. Further, such handles provide poor maneuverability in the mouth during brushing. In order to compensate said low bending stiffness, the size of the cross-sectional area of the handle could be increased. However, relatively thick handles may also reduce ease of rotating the brush in the hand, thus, impeding the user reaching all areas in the oral cavity. Consequently, maneuverability of the overall brush is not sufficient. However, in order to achieve and preserve good oral health, and to prevent gingivitis, it is important to clean teeth and gums thoroughly, in particular in hard to reach areas, e. g. in the region of the back molars. Further, gaps between teeth and periodontium, the so called gingival groove has to be thoroughly cleaned which requires a good and well-coordinated brushing technique, which may not be achievable by using the above-mentioned manual toothbrushes. Further, it is known that users/consumers use different brushing techniques, and, therefore, it is critical to identify optimal ergonomics of a toothbrush in order to provide good sensory feeling during brushing when using all types of brushing techniques.

It is an object of the present disclosure to provide an oral care implement which overcomes at least one of the above-mentioned drawbacks, in particular an oral care implement which does not tip over when loaded with toothpaste and placed on a substantially planar surface. Further, the oral care implement shall provide more comfort and improved quality perception as well as better maneuverability in the oral care cavity during brushing. It is also an object of the present disclosure to provide a method for manufacturing such oral care implement.

SUMMARY OF THE INVENTION

In accordance with one aspect an oral care implement is provided, the oral care implement having an overall length extension extending between a proximal end and a distal end, the distal end being opposite the proximal end, the oral care implement comprising a head at the proximal end and a handle, the handle being at least partially made from a material having a density being higher than the density of the material of the head, the oral care implement having a center of gravity located at a distance measured from the distal end, wherein the ratio of said distance to the overall length extension of the oral care implement is from about 0.30 to about 0.45, preferably from about 0.35 to about 0.42, further preferably from about 0.38 to about 0.41.

In accordance with one aspect a kit is provided, the kit comprising such oral care implement and a holder for attaching and holding the oral care implement.

In accordance with one aspect, a method for manufacturing such oral care implement is provided, the method comprising the following steps:

- providing an amorphous thermoplastic resin,
- providing aluminum oxide, boron nitride or aluminum silicate,
- providing iron oxide,
- mixing the amorphous thermoplastic resin, aluminum oxide, boron nitride or aluminum silicate and iron oxide into a magnetic and/or ferromagnetic molding material,
- heating the molding material mixture into a flowable molding material,
- molding the flowable molding mixture into a handle or part of a handle,
- providing a non-magnetic and/or non-ferromagnetic material, and
- molding the non-magnetic and/or non-ferromagnetic material into a head or part of a head.

BRIEF DESCRIPTION OF THE DRAWINGS

The invention is described in more detail below with reference to various embodiments and figures, wherein.

DETAILED DESCRIPTION OF THE INVENTION

The oral care implement according to the present disclosure comprises a handle and a head on which at least one tooth cleaning element, e.g. a tuft of bristles and/or an elastomeric element, may be fixed. The head may be repeatedly attachable to and detachable from the handle. Alternatively, the head may be permanently attached to the handle. The oral care implement may be a manual toothbrush. The oral care implement may also be an inter-proximal pick, a plaque scraper or tissue/tongue cleanser.

Figure 4:
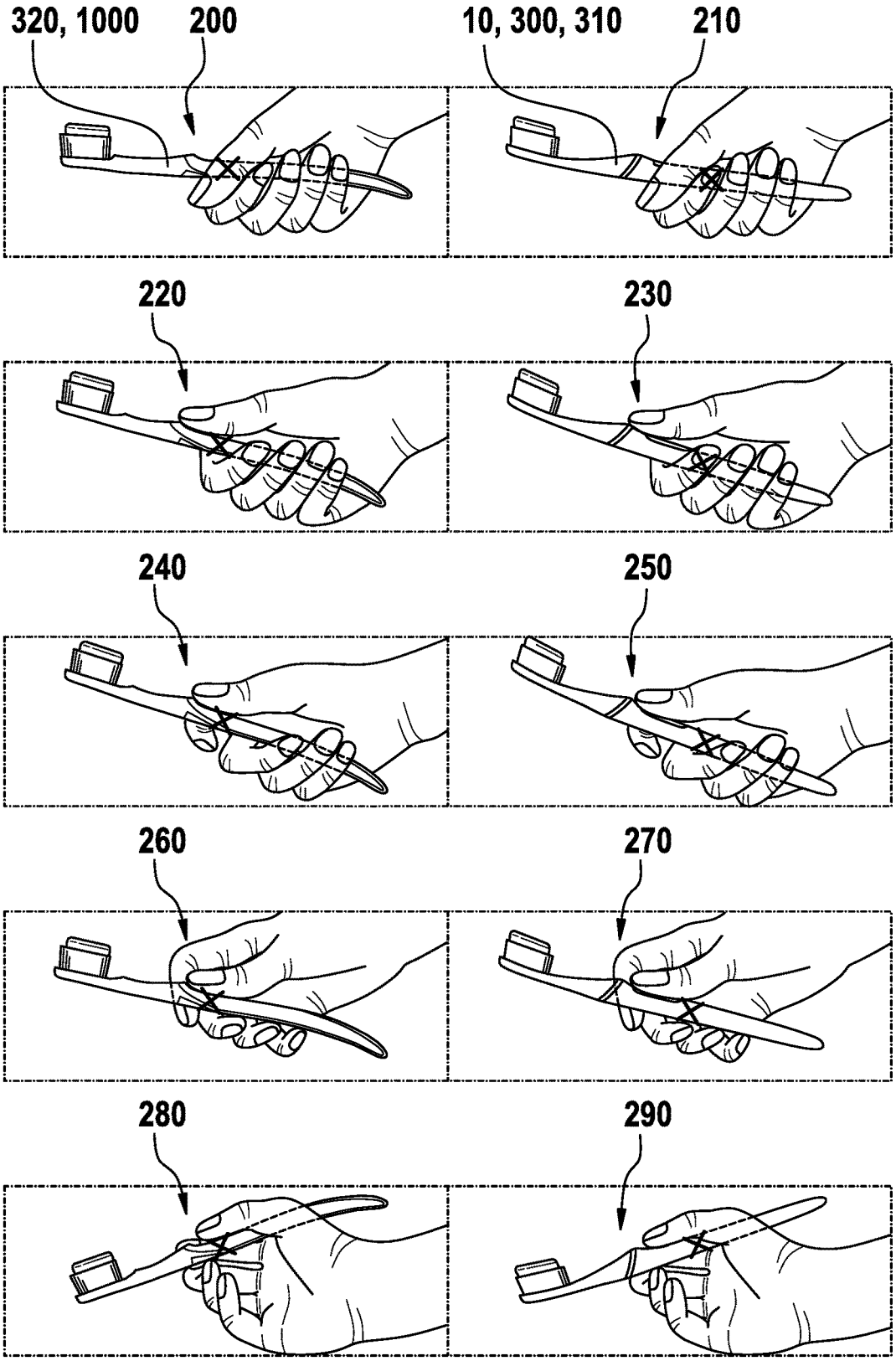
FIG. 4 shows five basic grip styles how users hold a toothbrush during brushing.

The oral care implement has an overall length extension extending between a proximal end, i.e. the end where the head is located, and a distal end. The center of gravity of the oral care implement is located at a distance measured from the distal end of the oral care implement. The ratio of said distance to the overall length extension of the oral care implement is from about 0.30 to about 0.45, or from about 0.35 to about 0.42, or from about 0.38 to about 0.41. Such ratio provides an oral care implement having the center of gravity closer to the center of the length extension of the handle, as compared to toothbrushes according to the state of the art. Consequently, when the user holds the oral care implement in his hand during brushing, the center of gravity is closer to the pivot point of the wrist joint enabling better control of the oral care implement in the mouth, thereby allowing more precise and accurate brushing movements. In other words, the center of gravity lies within the handle (even if the brush head is loaded with toothpaste), thereby enabling users to perform a well-coordinated brushing technique with improved sensory feeling during brushing. The center of gravity positioned substantially in the center of the handle renders the oral care implement balanced. The oral care implement does not easily tip over/does not get head loaded once toothpaste is applied onto the brush head. When applying the different brushing techniques as shown in FIG. 4, the toothbrush according to the present disclosure has the advantage that the center of gravity is in or very close to the pivot point of the wrist joint, thereby enabling better cleaning. Handling properties of the oral care implement are significantly improved.

The overall length extension of the oral care implement may be from about 180 mm to about 220 mm, or about 200 mm. The length extension of the handle may be ⅔ of the overall length extension of the oral care implement.

The oral care implement has a front side and a back side, the back side being opposite the front side. The front side is defined as the side from which the at least one tooth cleaning element extends. The handle has a cross sectional area which extends substantially perpendicular to the overall length extension of the oral care implement. The height extension of the cross-sectional area is defined as the maximum extension between the front side and the back side of the oral care implement.

The center of gravity of the oral care implement may be located at a position which is closer to the back side than to the front side of the oral care implement, the position being measured along the height extension of the cross-sectional area of the handle. If the oral care implement is loaded with toothpaste and placed on a substantially planar/flat surface, the center of gravity is below the axis of rotation which renders the overall oral care implement stable and balanced. The oral care implement returns automatically to an upright position (i.e. into a position which keeps the toothpaste away from/opposite to the surface) once the oral care implement is moved out of the balanced position.

The handle of the oral care implement is at least partially made from a material having a higher density than the density of the material from which the head—optionally including the shaft/neck—is made. At least a portion of the head, e g. the neck/shaft and the bristle carrier may be made from a material having a density from about 0.5 g/cm$^3$ to about 1.2 g/cm$^3$, or from about 0.7 g/cm$^3$ to about 1.0 g/cm$^3$, or about 0.9 g/cm$^3$. For example, the head and the neck may be injection molded from a thermoplastic polymer, e.g. polypropylene having a density of about 0.9 g/cm$^3$. In contrast to the head, the handle is at least partially made from a material having a significant higher density, e.g. a density from about 2.1 g/cm$^3$ to about 3.1 g/cm$^3$, or from about 2.3 g/cm$^3$ to about 2.8 g/cm$^3$, or from about 2.5 g/cm$^3$ to about 2.7 g/cm$^3$.

Usually, users are accustomed that products, in particular in the personal health care sector, have a specific weight that guarantees high product quality and provides comfortable feeling during use of the product. As the weight of the handle material is relatively high, the oral care implement according to the present disclosure provides such high-quality perception and comfortable feeling during use. The oral care implement according to the present disclosure provides superior product quality perception.

An oral care implement comprising a head being repeatedly attachable to and detachable from the handle provides several benefits: While the high quality and relatively expensive handle of the oral care implement is adapted for use over a longer period of time as compared to common manual toothbrushes which are discarded after about three months of use, the relatively cheap brush refill can be exchanged on a regular basis, e.g. after about three months. This provides a cost-efficient and environmentally sustainable high quality oral care implement with improved handling properties. The head of the oral care implement may be attachable to the handle via a snap-fit locking mechanism. For example, the handle may comprise a connector which may be insertable into a hollow portion in the head, or the head may comprise a connector insertable into a hollow portion in the handle.

Alternatively, a connector may be provided as a further, i.e. separate part of the oral care implement. Such connector may be insertable into a hollow portion in the handle and into a hollow portion the head, respectively, thereby providing a sufficiently strong connection and sufficient stability between the head and the handle to enable a user to perform a brushing action.

In the past, it has been seen that after use of the brush/after brushing the teeth the user usually stores the wet brush in a toothbrush beaker for drying. However, in a classical toothbrush beaker, drained fluids get collected and accumulated at the bottom of the beaker, and the fluids stay in contact with the toothbrush for a longer period of time. Since the beaker is open on one side only, the toothbrush dries relatively slowly. Bacteria living in wet conditions/in a wet environment can grow quickly, contaminate the toothbrush and finally render the brush unhygienic. Consequently, there exists a need for a solution for hygienically storing and drying a manual toothbrush, thereby enabling remaining water, toothpaste slurry and saliva to drain off from the brush. The brush shall dry quickly thereby inhibiting bacterial growth.

The material of the head may be made from a non-magnetic or non-ferromagnetic material, while the material of the handle may be made from a magnetic and/or ferromagnetic material. Magnetic/ferromagnetic material possesses not only a relatively high density, and, thus, a relatively heavy weight, which provides the oral care implement with the above-mentioned benefits, but the magnetic/ferromagnetic material also makes the oral care implement magnetically attachable to a magnetic holder. The magnetic/ferromagnetic material of the handle may allow for hygienic storage of the oral care implement. If the oral care implement is magnetically attached to a magnetic holder, remaining water, toothpaste slurry and saliva can drain off from the brush. The oral care implement can dry relatively quickly. Consequently, bacteria growth can significantly be reduced, thereby rendering the oral care implement more hygienic. In contrast to a common toothbrush being stored in a toothbrush beaker where drained fluids get collected and accumulated at the bottom of the beaker, the brush according to the present disclosure is exposed to wet conditions over a significantly shorter period of time.

For example, the magnetic holder may have the form of a flat disk attachable to a wall. Such flat disk may represent an easy to clean surface. Further, a user just needs to bring the oral care implement in close proximity to the magnetic holder, and then the oral care implement gets attached automatically. No precise positioning or threading as with common toothbrush holders is required. Since the magnetic properties are merely provided in the handle, and not in the head, the head portion cannot accidentally be attached to the magnetic holder, thereby reducing the risk that the magnetic holder gets soiled.

The magnetic and/or ferromagnetic material forming at least a part of the handle may comprise an amorphous thermoplastic resin. The magnetic and/or ferromagnetic material may further comprise aluminum oxide, boron nitride or aluminum silicate. Furthermore, the magnetic and/or ferromagnetic material may comprise in addition or alternatively iron oxide. The magnetic and/or ferromagnetic material may further comprise glass fibers which may be pre-mixed with at least a portion of the amorphous thermoplastic resin. Such handle material allows for control of the weight of the handle in whatever location, e.g. by filler variation. Control of the overall toothbrush is required due to the relatively high weight of the handle. It is now possible to use the mass/weight distribution of the material for adaption of the inertial moment of the finished toothbrush.

The magnetic and/or ferromagnetic material may comprise from about 13 weight percent to about 30 weight percent of an amorphous thermoplastic resin; from about 3 weight percent to about 25 weight percent of aluminum oxide, boron nitride or aluminum silicate; and from about 45 weight percent to about 67 weight percent of iron oxide. Such composition provides a material density that is about three times the density of a standard plastic material used for toothbrushes, e.g. polypropylene. With the higher weight and higher thermal conductivity, the material drives value perception, in particular in combination with a galvanic coating. Such coating may be made from real metal. The galvanic coating can be applied in a selective electroplating process. During this coating process for a multicomponent plastic part, a metallic layer is only deposited on a hard material while a further over molded soft component may remain unaffected.

The magnetic and/or ferromagnetic material may comprise about 27.5 weight percent of an amorphous thermoplastic resin, about 17 weight percent of aluminum oxide, about 51 weight percent of iron oxide, and about 4.5% glass fiber.

The amorphous thermoplastic resin may comprise a styrene resin, e.g. styrene acrylonitrile "SAN". The amorphous thermoplastic resin may be selected from the list consisting of acrylonitrile butadiene styrene, polystyrene, and styrene acrylonitrile.

The amorphous thermoplastic resin may comprise about 17% weight percent styrene acrylonitrile, and 10.5 weight percent of a mixture comprising polybutylene terephthalate and polyethylene terephthalate.

Surprisingly, it has been found out that said composition provides a high gravity molding material appropriate for injection molding or extrusion molding. A high specific gravity molding material high in surface hardness, excellent in coating characteristics as well as excellent in thermal conductivity is provided.

The use of molding materials having a relatively high specific gravity is known. Such molding materials usually contain a polymeric resin and a high-density filler such as iron oxide. However, in such molding materials the amount of iron oxide which can be included is limited as the thermal conductivity properties of the molding material are relatively poor. Thus, on the one side, lower thermal conductivity leads to relatively longer cycle times during manufacturing to allow the molding material to cool after molding. On the other side, if heavy polymeric materials are filled with high heat conductive additives such as metal powder or fibers, the addition of these materials leads to tight process windows in molding because of the immediate freezing when the molten material contacts the cold wall of the tool. This fast freezing leads to high injection speed and low flow length to wall thickness ratio at the produced part.

Now, it has been surprisingly found out that the molding material according to the present disclosure has a high specific gravity and optimally controlled thermal conductivity properties to reduce or expand the time needed for the molding material to cool during or after injection molding. Surprisingly, it has been found out that a relatively high percentage of iron oxide can be maintained in the molding material while improving on the thermal conductivity properties of the molding material. The addition of aluminum oxide, boron nitride or aluminum silicate provides the molding material with improved thermal conductivity as compared to materials containing a styrene resin and iron oxide only. This improved thermal conductivity may lead to lower cycle times as the molding material needs less time to cool after molding.

Another benefit of adding aluminum oxide, boron nitride or aluminum silicate to the material is the ability to increase the overall amount of iron oxide in the molding material as compared with materials comprising iron oxide and resins of the past. The improvements in the molding material properties come from the addition of relatively small amounts of aluminum oxide, boron nitride or aluminum silicate. A material composition comprising a relatively high percentage of iron oxide (magnetite), i.e. from about 45 weight percent to about 67 weight percent, preferably about 51 weight percent, provides good magnetic properties and a relatively heavy weight of the overall material.

Styrene acrylonitrile "SAN" provides high thermal resistance properties. The acrylonitrile units in the chain enable SAN to have a glass transition temperature greater than 100° C. The properties of SAN may allow for reduced cycle time due to relatively earlier and quicker transition temperature. Amorphous polymers are suitable for heavy resin compounds of the present disclosure due to the glass transition temperature Tg at which an amorphous polymer is transformed, in a reversible way, from a viscous or rubbery condition to a hard one. By injection molding of the heavy resin material of the present disclosure the temperature of the material melt is above the Tg region (viscous or rubbery condition). During cooling the compound attains the high Tg temperature early and reaches dimensional stability (glassy condition). Over-molding of the heavy resin material is possible as the material stays dimensional stable due to the high Tg of the material.

Polybutylene terephthalate (PBT) and/or polyethylene terephthalate (PET) provide the handle with high quality surface properties, including improved optical characteristics, and high impact strength. Once heated, a mixture of PBT and PET represent a high temperature-resistant melt having low viscosity and a high Melt Flow Index (MFI). Therefore, processability of the magnetic/ferromagnetic material during molding is improved.

It is known, that heavy resin materials tend to show high shrinkage effects for products having thick walls/dimensions. However, it has been surprisingly found out that glass fibers added to the magnetic/ferromagnetic material provide the material composition with improved stability and low shrinkage effects.

A method for manufacturing an oral care implement according to the present disclosure comprises the following steps:

- providing an amorphous thermoplastic resin,
- providing aluminum oxide, boron nitride or aluminum silicate,
- providing iron oxide,
- mixing the amorphous thermoplastic resin, aluminum oxide, boron nitride or aluminum silicate and iron oxide into a magnetic and/or ferromagnetic molding material,
- heating the molding material mixture into a flowable molding material,
- molding the flowable molding mixture into a handle or part of a handle,
- providing a non-magnetic and/or non-ferromagnetic material, and molding the non-magnetic and/or non-ferromagnetic material into a head or part of a head.

The amorphous thermoplastic resin may comprise styrene acrylonitrile, polybutylene terephthalate and polyethylene terephthalate, wherein polybutylene terephthalate and polyethylene terephthalate may be premixed with glass fibers. The amorphous thermoplastic resin may be provided in a range from about 13 weight percent to about 30 weight percent; the aluminum oxide, boron nitride or aluminum silicate may be provided in a range from about 3 weight percent to about 25 weight percent; and the iron oxide may be provided in a range from about 45 weight percent to about 67 weight percent.

The magnetic and/or ferromagnetic material may comprise about 17 weight percent of styrene acrylonitrile; about 10.5 weight percent of a composition comprising polybutylene terephthalate and polyethylene terephthalate; about 4.5 weight percent of glass fibers; about 17 weight percent of aluminum oxide; and about 51 weight percent of iron oxide.

The material composition may be made by blending the amorphous thermoplastic resin with powder of aluminum oxide, boron nitride or aluminum silicate, and with iron oxide powder. Increasing the amount of iron oxide within the material composition has further the advantage of providing a lower cost molding material because iron oxide powder is less expensive than the other filling agents. Amorphous thermoplastic resin, glass fibers, aluminum oxide/boron nitride or aluminum silicate powder, and iron oxide powder may be blended by using a uniaxial extruder, a biaxial extruder, a kneader, a Banbury mixer, a roll or other such extruders. After blending the material is heated to become flowable. The flowable material may then be molded into a handle or part of a handle by either injection molding or extrusion molding.

In an additional step, the handle or part of the handle may be electroplated to add improved appearance and a pleasant feel. Thermoplastic elastomers are well suited for electroplating as they allow for the creation of both hard and soft composite components to be electroplated selectively in one operation.

For example, the handle may comprise a thumb rest being made from a thermoplastic elastomer material and/or from a polypropylene material. These materials can be easily injection molded over the heavy resin material as discussed above. Such thumb rest may provide the handle of the oral care implement with improved handling properties, e.g. with anti-slip properties to improve the maneuverability of the oral care implement under wet conditions, e.g. when the user brushes his teeth. The thumb rest may be made from thermoplastic elastomer having a Shore A hardness from about 30 to about 60, or about 40 to prevent the oral care implement from being too slippery when used in wet conditions. At least a portion of the thumb rest may have a concave shape with an angle $\alpha$ with respect to the area of the remaining portion of the thumb rest from about 20° to about 25°, or about 24°. The thumb rest or a gripping region may be attached onto the front surface of the handle in the region close to the proximal end, i.e. closest to the head. The thumb rest may comprise a plurality of ribs extending substantially perpendicular to the longitudinal axis of the oral care implement. Such ribs may allow users/consumers to use the oral care implement with even more control. The user/consumer can better grasp and manipulate the handle of the oral care implement during brushing. Such handle may provide further improved control and greater comfort during brushing, in particular under wet conditions.

Furthermore, the handle may be made from at least two, or at least three different materials, each forming different parts of the handle. For example, a first material according to the present disclosure, e.g. a magnetic and/or ferromagnetic material may be injection molded into a first component of the handle thereby forming an underlying base structure of the oral care implement. A second component, e.g. of polypropylene material may be injection molded over the first component, and/or a third component, e.g. of thermoplastic elastomer material may be injection molded over the first component and/or the second component.

The third component of thermoplastic elastomer material may form the thumb rest on the front surface of the oral care implement and/or a palm grip on the back surface being opposite the front surface to be gripped by the user's/consumer's fingers and thumb. Such handle configuration may even further resist slippage during use. The thermoplastic elastomer material may extend through an aperture provided in the underlying base structure and/or second component of the handle.

The tooth cleaning elements of the oral care implement, e.g. bundle of filaments forming one or a plurality of tufts, may be attached to the head by means of a hot tufting process. One method of manufacturing the head with tufts of filaments embedded in the head may comprise the following steps: In a first step, tufts are formed by providing a desired amount of filaments. In a second step, the tufts are placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. In a third step the head is formed around the ends of the filaments extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement is formed. Before starting the injection molding process the ends of the tufts extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tufts on the finished head of the oral care implement. In other words, the tufts attached to the head by means of a hot tufting process are not doubled over a middle portion along their length and are not mounted in the head by using an anchor/staple. The tufts are mounted on the head by means of an anchor-free tufting process.

Alternatively, the head for the oral care implement may be provided with a bristle carrier having at least one tuft hole, e.g. a blind-end bore. A tuft comprising a plurality of filaments may be fixed/anchored in said tuft hole by a stapling process/anchor tufting method. This means, that the filaments of the tuft are bent/folded around an anchor, e.g. an anchor wire or anchor plate, for example made of metal, in a substantially U-shaped manner. The filaments together with the anchor are pushed into the tuft hole so that the anchor penetrates into opposing side walls of the tuft hole thereby anchoring/fixing/fastening the filaments to the bristle carrier. The anchor may be fixed in opposing side walls by positive and frictional engagement. In case the tuft hole is a blind-end bore, the anchor holds the filaments against a bottom of the bore. In other words, the anchor may lie over the U-shaped bend in a substantially perpendicular manner. Since the filaments of the tuft are bent around the anchor in a substantially U-shaped configuration, a first limb and a second limb of each filament extend from the bristle carrier in a filament direction. Filament types which can be used/are suitable for usage in a stapling process are also called "two-sided filaments". Heads for oral care implements which are manufactured by a stapling process can be provided in a relatively low-cost and time-efficient manner.

The following is a non-limiting discussion of example embodiments of oral care implements and parts thereof in accordance with the present disclosure, where reference to the Figures is made.

Figure 1:
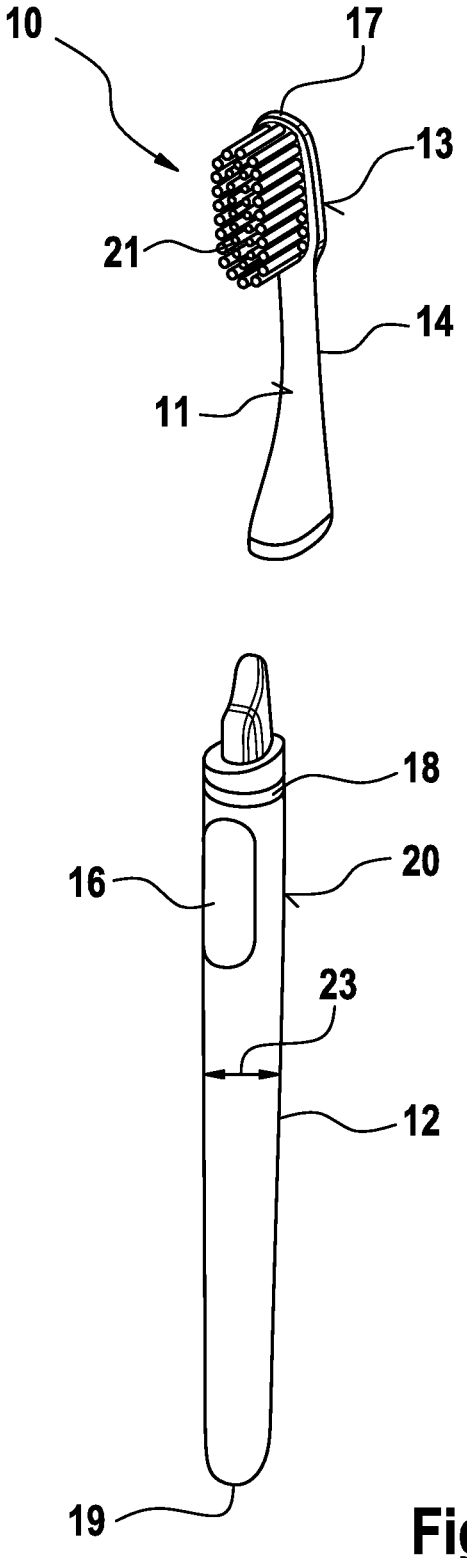
FIG. 1 shows a perspective view of an example embodiment of an oral care implement according to the present disclosure, wherein the head of the oral care implement is detached from the handle.

FIG. 1 shows an oral care implement 10, in this specific embodiment a manual toothbrush 10, the manual toothbrush 10 comprising a handle 12 and head 14 being repeatedly attachable to and detachable from the handle 12. The oral care implement 10 has a front side 11 and a back side 13. An overall length extension 15 extends between a proximal end 17 and a distal end 19 of the implement 10 (cf. FIG. 2). Tooth cleaning elements 21 are attached to the head 14 and extend from the front side 11. The handle 12 may be formed by using the process as shown in the flow chart of FIG. 3 and as further explained below. The handle 12 may be molded from a magnetic and/or ferromagnetic material. In addition, the handle 12 may have been undergone electroplating with any additional material, for example a polyethylene material or a thermoplastic elastomer to create a soft region, e.g. a thumb rest 16. The soft region/thumb rest 16 may improve comfort and feel of the handle 12. Alternatively, or in addition, by a further electroplating step the handle 12 may be provided with a metal layer 18 directly on the magnetic and/or ferromagnetic material of the present disclosure to further improve the appearance of the handle 12. For example, the metal layer 18 may have the form of a ring surrounding the outer circumference 20 of the handle 12.

Figure 2:
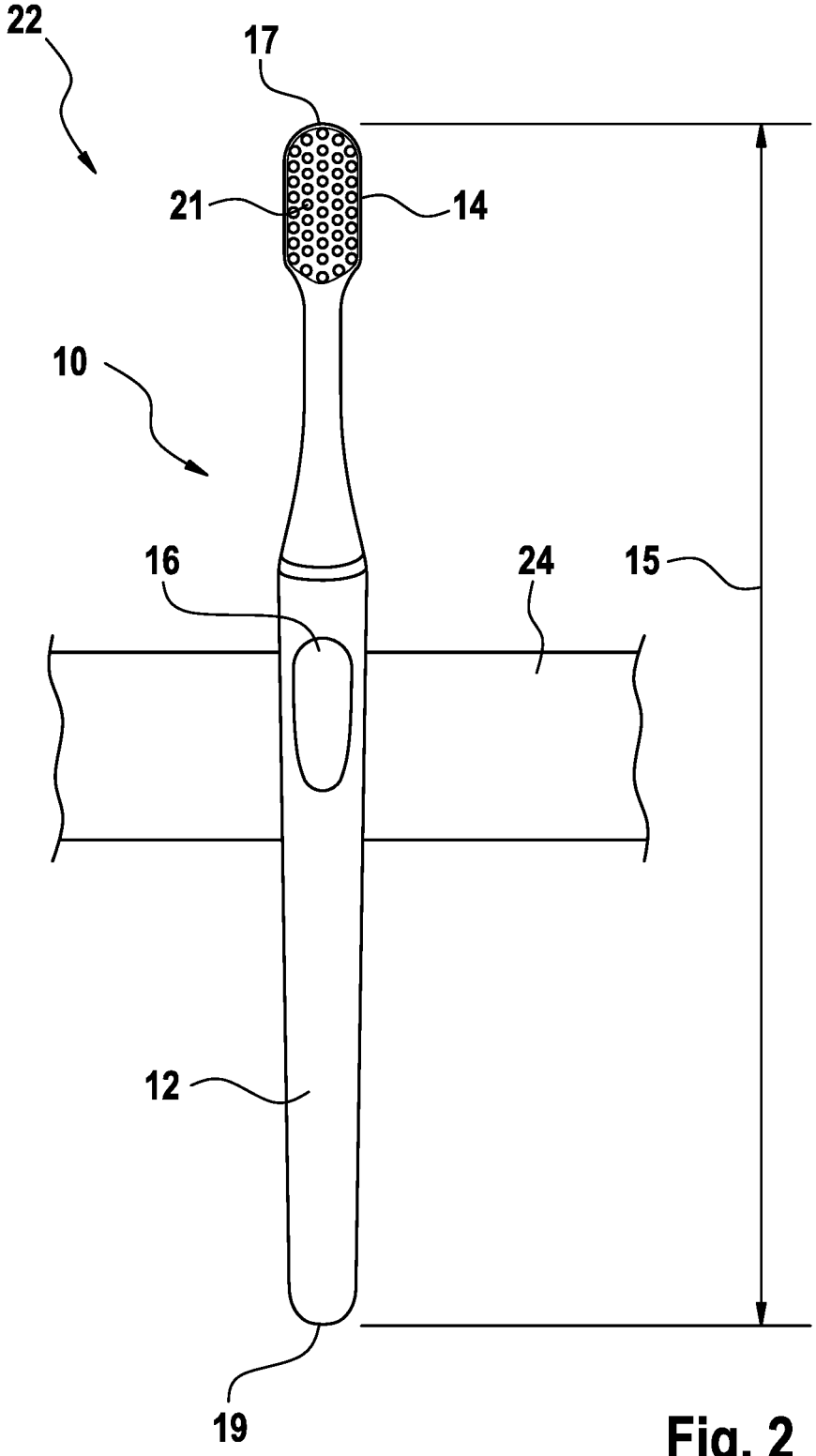
FIG. 2 shows a perspective view of an example embodiment of a kit comprising the oral care implement of FIG. 1, and a magnetic holder at which the oral care implement is magnetically attached.

The material of which the handle 12 is at least partially made possesses magnetic and/or ferromagnetic properties. FIG. 2 shows a kit 22 comprising a manual toothbrush 10 with handle 12 to which head 14 is attached, and a magnetic holder 24 onto which toothbrush 10 is magnetically attached.

Figure 3:
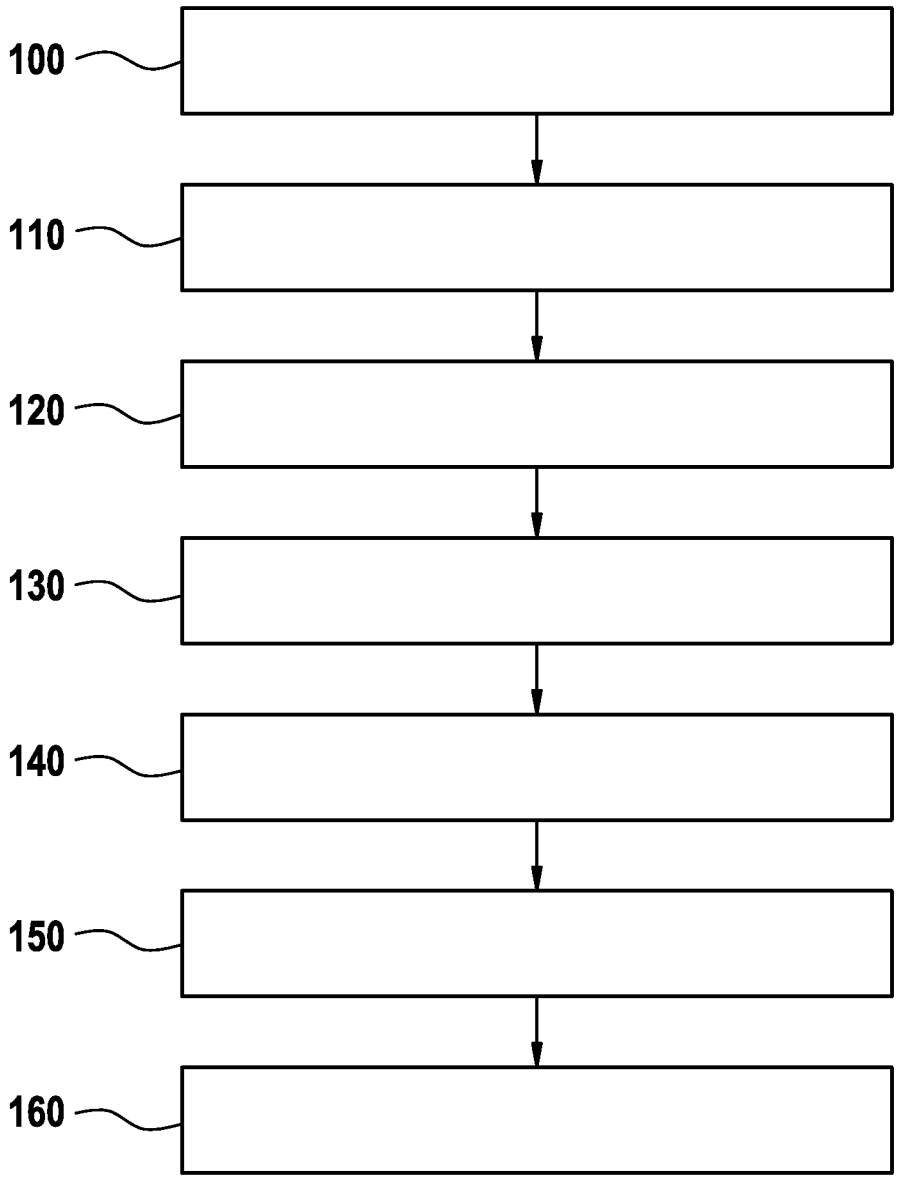
FIG. 3 shows a diagram of a flow chart for molding the handle of the oral care implement according to the present disclosure.

FIG. 3 shows a diagram of a flow chart illustrating the steps of making a handle 12 or a portion of a handle of the oral care implement 10 according to the present disclosure. An amorphous thermoplastic resin, optionally comprising glass fibers, is provided at 100. Aluminum oxide, boron nitride or aluminum silicate is provided at 110. Iron oxide is provided at 120. At 130, the amorphous thermoplastic resin (optionally comprising glass fibers), the aluminum oxide, boron nitride or aluminum silicate, and the iron oxide are mixed into a molding material. The molding material is then heated into a flowable condition at 140. The heated and flowable molding material is molded into a handle 12 or part of a handle at 150. The molding step may be either an injection molding or extrusion molding step. The optional step of electroplating the oral care implement/handle is shown at 160.

The material according to the present disclosure is an alternative to metal/zinc-die-cast material. The material of the disclosure enables to offer an attractive solution with respect to the manufacturing process according to the present disclosure, price and environment. This alternative allows the handle to have the look and feel in the final state like a metal product. At the same time the material of the present disclosure should be easily processable by injection molding and should save on the assembly effort. For example, for the process of the present disclosure there are three basic steps required: (1) injection molding of the handle 12; (2) two-component injection molding of hard material and/or soft material, e.g. to form a thumb rest 16; and (3) electroplating of the handle, e.g. to form a metal layer in the form of a ring 18. In contrast, when using a zinc-die-cast material five steps are needed: (1) manufacturing of the zinc-die-casted main part; (2) deflashing of the main part; (3) electroplating the main part; (4) separately producing a soft material part; (5) and assembling the main part with the separately produced soft material part. A lubricant may be added to the material to improve the molding processing fluidity.

Table 1 shows the flowability and heat transfer results of several different formulas/material compositions:

TABLE 1

Flowability and heat transfer

| Test-No. | 20% SAN 80% Iron oxide | 20% SAN 5% Aluminum oxide 75% Iron oxide | 15% SAN 10% Aluminum oxide 75% Iron oxide | 17% SAN 16% Aluminum oxide 67% Iron oxide |
|---|---|---|---|---|
| Specific weight [g/cm$^3$] | 2.91 | 2.95 | 2.99 | 3.06 |
| 1 | 21 | 16 | 13 | 9 |
| 2 | 20 | 16 | 13 | 9 |
| 3 | 20 | 16 | 13 | 10 |
| 4 | 21 | 16 | 13 | 9 |
| 5 | 20 | 16 | 14 | 9 |
| 6 | 20 | 16 | 13 | 8 |
| 7 | 20 | 16 | 13 | 9 |
| 8 | 20 | 16 | 13 | 9 |
| 9 | 20 | 16 | 13 | 9 |
| 10 | 20 | 16 | 13 | 9 |
| Average (cm) | 20.2 | 16 | 13.1 | 9 |
| Content Al—Ox [%] | 0 | 5 | 10 | 16 |
| Heat transfer rate | 0.87 | 0.96 | 1.2 | 1.43 |
| [W/m*K] | 0.89 | 1.06 | 1.22 | 1.41 |
| | 0.88 | 1.01 | 1.23 | 1.44 |
| Average Value [W/m*K] | 0.88 | 1.01 | 1.21666667 | 1.42666667 |

Figure 11:
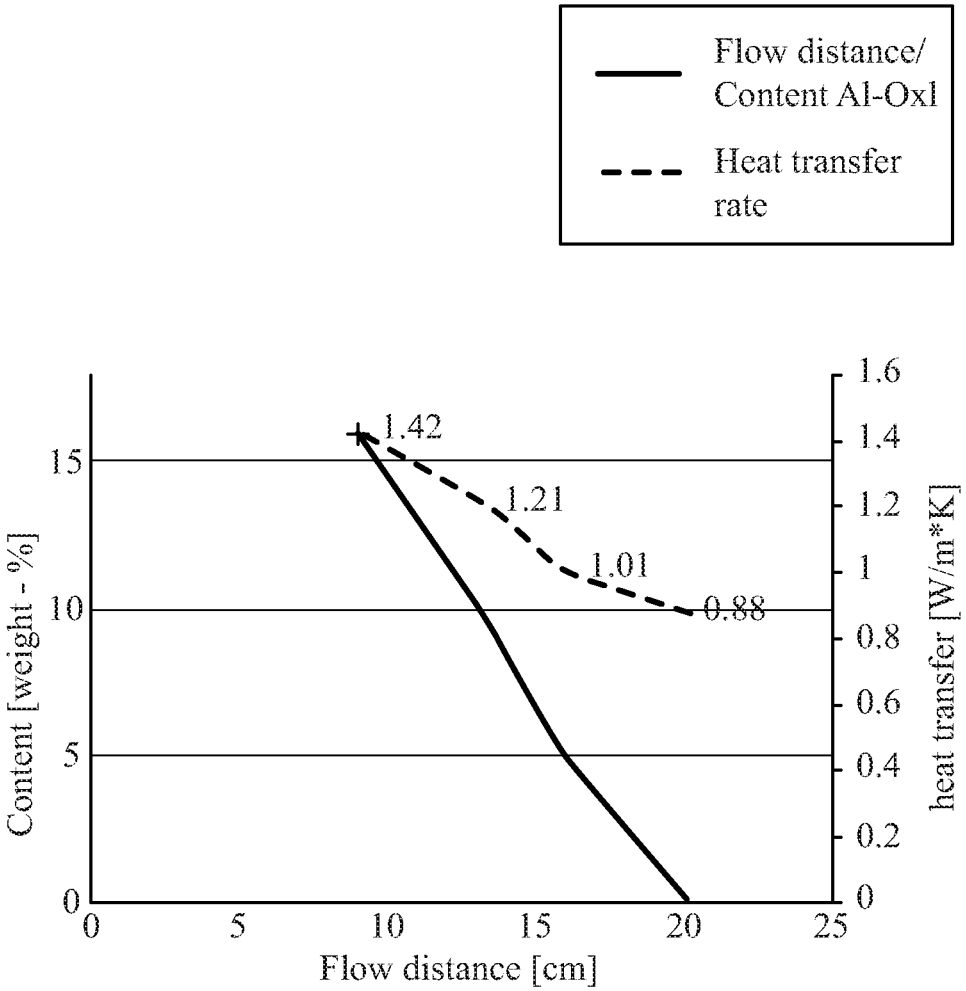
FIG. 11 is a graph showing average results of heat transfer and flow distance.

Graph 1, shown in FIG. 11, plots the average results of heat transfer and flow distance of the formulas from Table 1.

As can be seen, different fillers and different concentrations of fillers control the thermal conductivity or heat transmission and flowability of the material.

The heat energy and shear heating affect the fluidity of the heavy resin material, and thereby the process window for an effective injection molding process can be exactly controlled. Further, with the ability of the material of the present disclosure to fill any available cavities within the mold, it is possible to use the mass/weight distribution of the material for adaption of the inertial moment/center of gravity of the finished handle.

The material of the present disclosure provides several benefits: The handle manufactured with the material of the present disclosure looks and feels like a heavy metal handle and it is resistant to corrosion. The material also has manufacturing advantages and cost saving advantages with fast cycle times due to its heat transfer properties as compared to metal inserted or die-casted handles and products with assembled component parts. The material of the present disclosure requires less energy and other essential resources for manufacturing in comparison to zinc-die casted products.

In contrast to material compositions that are highly loaded with fillers, the magnetic/ferromagnetic material of the present disclosure shows optimized mechanical properties, in particular dimensional stability under heat and impact strength due to the improved melt viscosity and glass transition temperature.

The material of the present disclosure possesses the ability to adhere to other components/materials, e.g. substrates and resins, which is important for multicomponent injection molding, e.g. for molding handles comprising two or three different materials.

FIG. 4 shows five different grip styles/ways how users usually hold a toothbrush during tooth brushing: "Power Grip" 200, 210, "Oblique Grip" 220, 230, "Distal Oblique Grip" 240, 250, "Precision Grip" 260, 270 and "Spoon Grip" 280, 290. In the left column, the different grip styles 200, 220, 240, 260, 280 are shown when a user holds a toothbrush 320, 1000 according to the state of the art (cf. FIGS. 5, 6, 7, 8 and 9), while in the right column the respective grip styles 210, 230, 250, 270, 290 are shown when a user holds an oral care implement 10, 300, 310 (cf. FIGS. 5, 6, 7 and 10) according to the present disclosure. The center of gravity is indicated with "X". The grip styles can be defined by the following characteristics:

"Power Grip" 200, 210: Infrequently used; fingers wrap tightly around the handle; the thumb is mostly extended or wraps tightly around the handle; used by consumers thinking "more pressure cleans better", or as one of multiple changing styles during brushing for areas where consumers need better control, e.g. at the back molars or inner tooth surfaces. Some consumers are holding the handle at the lower end in order to reduce pressure. Also used by most kids when they start brushing on their own.

"Oblique Grp" 220, 230: Very often used; handle weight is loosely placed in the palm; thumb is extended relative to the forefinger; allows good grip and navigation similar to cutting with a knife. Most often used for brushing as this is a common style applied for several occasions during a day, e.g. eating, hair combing, brush sweeping. In most cases consumers using this style are applying the scrubbing technique (i.e. a forth and back movement) to clean their teeth.

"Distal Oblique Grip" 240, 250: Very often used; handle weight is loosely placed in the palm; thumb and ring finger oppose each other; allows good grip and navigation similar to cutting with a knife. Also often used for brushing as this is a common style applied for several occasions during a day, e.g. eating, hair combing, brush sweeping. In most cases consumers using this style are applying the scrubbing technique (i.e. a forth and back movement) to clean their teeth.

"Precision Grip" 260, 270: Infrequently used; weight of the handle mainly on fingertips; thumb and forefinger oppose each other; as this is a non-pressure style it is often used for hard to reach or sensitive areas, e.g. at the inner tooth surfaces. Often observed as transition grip to "Distal oblique" or "Oblique", but some consumers use it as their "only grip style".

"Spoon Grip" 280, 290: Frequently used in chopstick regions; forefinger and thumb oppose each other thereby holding the handle tightly. Based on consumer habits, i.e. "Chopstick" style is very common in Asia; very familiar as it is often used for other occasions; used similar to the "Precision" style as the gentle way to clean hard to reach or sensitive areas.

As derivable from FIG. 4, the center of gravity X of the toothbrush according to the present disclosure is shifted closer to the center of the length extension of the toothbrush handle as compared to the toothbrush according to the state of the art, even if the toothbrush head is loaded with toothpaste. Since the center of gravity is close to the center of the length extension of the handle, the toothbrush is better balanced and does not easily tip over/does not get head loaded once paste is applied onto the brush head. Further, as shown in FIG. 4, in all different grip styles the center of gravity is in or very close to the pivot point of the wrist joint. A balanced toothbrush is easier to control in the mouth and allows precise and accurate brushing movements, thereby enabling better cleaning of the teeth.

Figure 5:
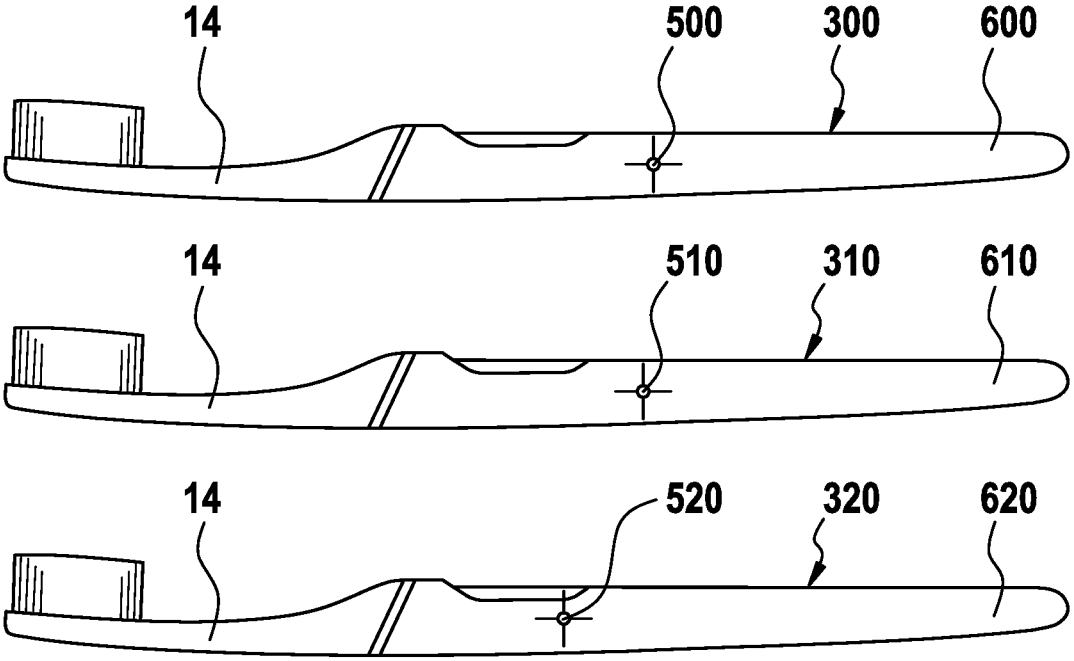
FIG. 5 shows two example embodiments of oral care implements according to the present disclosure and one oral care implement according to the state of the art, the oral care implements comprising different handle materials.
Figure 6:
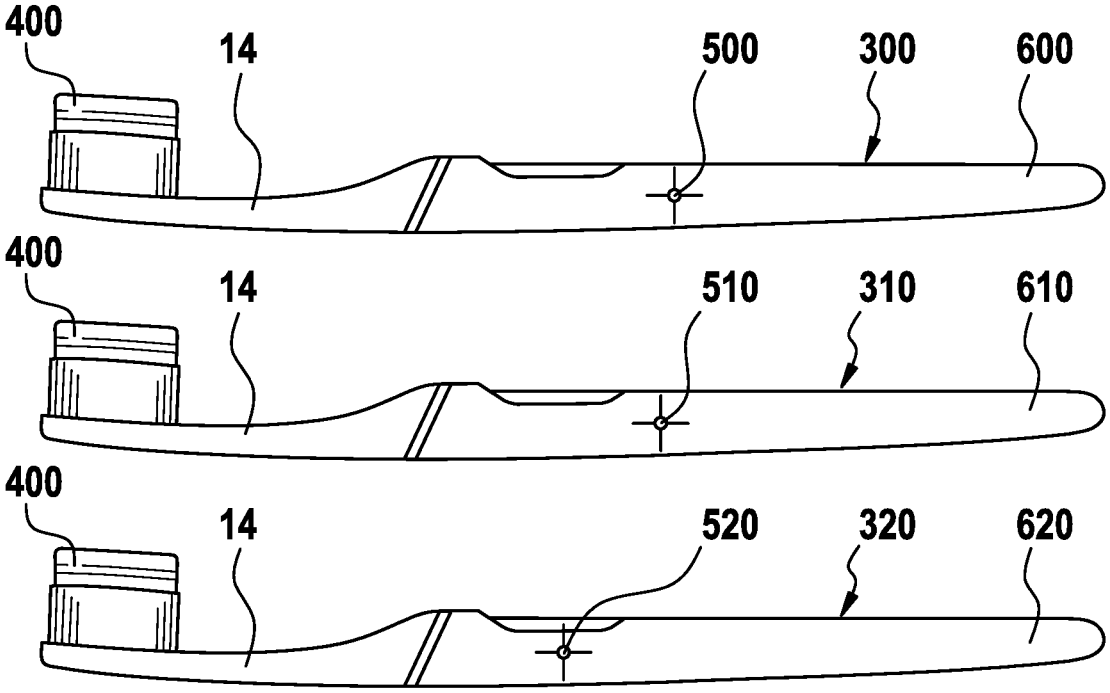
FIG. 6 shows the oral care implements of FIG. 5 with toothpaste applied onto the brush head.

FIG. 5 shows three toothbrushes 300, 310, 320 which are identical except from the handle material 600, 610, 620. FIG. 6 shows the toothbrushes 300, 310, 320 of FIG. 5, but loaded with toothpaste 400. Material compositions and characteristics of toothbrushes 300, 310, 320 are listed in Table 2:

TABLE 2

Material compositions and characteristics

| FIG. | Brush | Total mass [g] | Head material/ density [g/cm$^3$] | Handle material | handle material density [g/cm$^3$] |
|---|---|---|---|---|---|
| 5 | 300 | 48.7 | Polypropylene/0.9 | 15 wt % styrene acrylonitrile<br>10 wt % aluminum oxide<br>75 wt % iron oxide<br>Or alternatively:<br>17 wt % styrene acrylonitrile<br>16 wt % aluminum oxide<br>67 wt % iron oxide | 3.0 |
| 6 | 300 | 50.2 | Polypropylene/0.9 | 15 wt % styrene acrylonitrile<br>10 wt % aluminum oxide<br>75 wt % iron oxide<br>Or alternatively:<br>17 wt % styrene acrylonitrile<br>16 wt % aluminum oxide<br>67 wt % iron oxide | 3.0 |
| 5 | 310 | 41.7 | Polypropylene/0.9 | 17 wt % styrene acrylonitrile<br>10.5 wt % BPT and PET<br>4.5% glass fiber<br>17 wt % aluminum oxide<br>51 wt % iron oxide | 2.5 |
| 6 | 310 | 43.2 | Polypropylene/0.9 | 17 wt % styrene acrylonitrile<br>10.5 wt % BPT and PET<br>4.5% glass fiber<br>17 wt % aluminum oxide<br>51 wt % iron oxide | 2.5 |
| 5 | 320 | 19.3 | Polypropylene/0.9 | Polypropylene | 0.9 |
| 6 | 320 | 20.7 | Polypropylene/0.9 | Polypropylene | 0.9 |

The center of gravity of toothbrushes 300, 310, 320 are indicated with 500, 510, 520, respectively. As shown in FIGS. 5 and 6, center of gravity 500 of brush 300, and center of gravity 510 of brush 310 (according to the present disclosure) are closer to the center of the length extension of the toothbrush handle as compared to center of gravity 520 of brush 320 (according to the state of the art). Toothbrushes 300 and 310 are easier to control in the mouth and allow more precise and accurate brushing movements.

Figure 7:
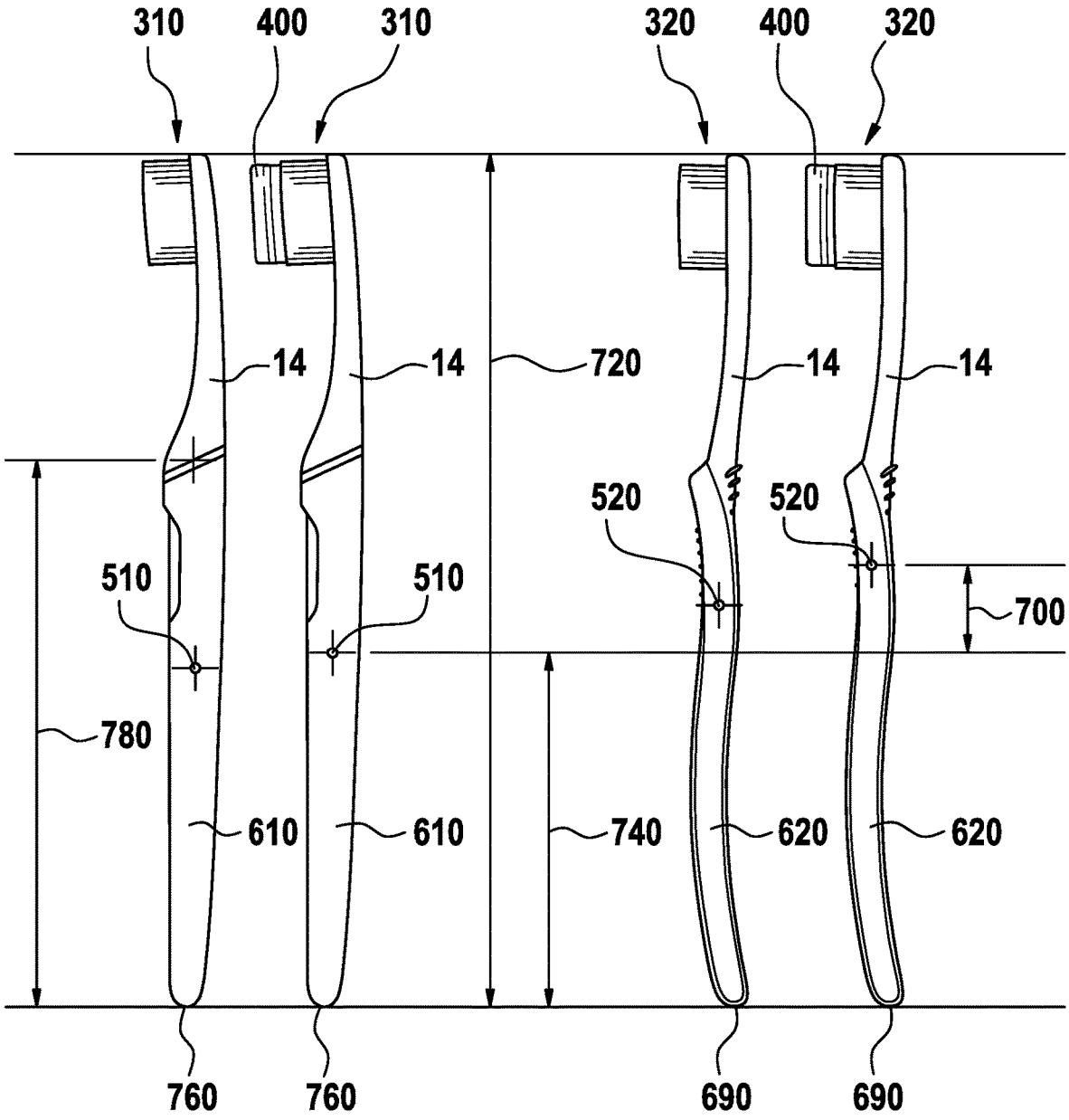
FIG. 7 shows a comparison of one of the example embodiment of FIGS. 5 and 6, and of the oral care implement according to the state of the art of FIGS. 5 and 6.

In FIG. 7 toothbrush 310 (without and with toothpaste) is compared with toothbrush 320 (with and without toothpaste). As clearly derivable from FIG. 7, the center of gravity 510 is closer to the center of the length extension of the handle than the center of gravity 520 of toothbrush 320. The center of gravity 510 of toothbrush 310 is shifted by distance 700.

Further, as shown in FIG. 7, toothbrush 310 has an overall length extension 720. The center of gravity 510 is located at distance 740 measured from the distal end 760 of the handle 610. The ratio of the distance 740 of the center of gravity 510 measured from the distal end 760 to the overall length extension 720 of the oral care implement 310 may be from about 0.30 to about 0.45, or from about 0.35 to about 0.42, or from about 0.38 to about 0.41. Such ratio provides a toothbrush having a center of gravity being close to the pivot point of the wrist joint during brushing. When using the grip styles shown in FIG. 4, the toothbrush is easier to control in the mouth, thereby allowing more precise and accurate brushing movements.

The overall length extension 720 of the oral care implement 310 may be from about 180 mm to about 220 mm, or about 200 mm, while the handle 610 of said oral care implement 310 may have a length extension 780 from about 120 mm to about 140 mm, or about from 125 mm to about 131 mm, or about 130 mm. The center of gravity 510 (when the oral care implement 310 is loaded with 1.4 g toothpaste) is located at about 83 mm, measured from the distal end 760 of handle 610.

In contrast to toothbrush 310, toothbrush 320 (according to the state of the art) has a center of gravity 520 located at a distance of about 194 mm measured from the distal end 690 (when toothbrush 320 is loaded with about 1.4 g toothpaste). The center of gravity 510 of toothbrush 310 is shifted towards the distal end 760 of handle 610 by 111 mm (in comparison to toothbrush 320).

Figure 8:
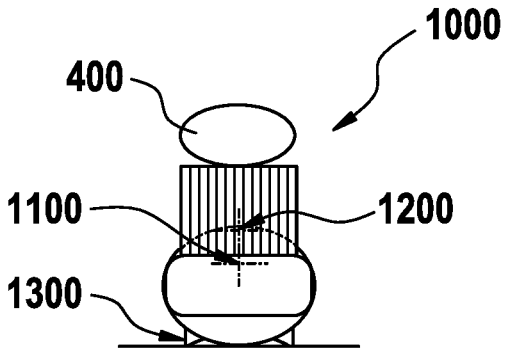
FIG. 8 shows a top view of an oral care implement according to the state of the art.
Figure 9:
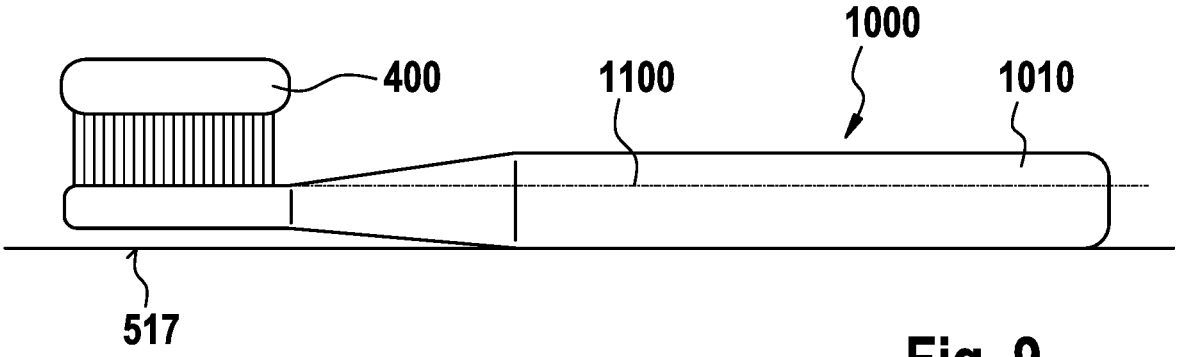
FIG. 9 shows a side view of the oral care implement of FIG. 8.

FIGS. 8 and 9 show in a front view and side view, respectively, axis of rotation 1100 and center of gravity 1200 of toothbrush 1000 according to the state of the art. Toothbrush 1000 comprises a handle 1010 made of polypropylene having a density of about 0.9 g/cm$^3$. Toothbrush 1000 is loaded with about 1.4 g of toothpaste and placed on a substantially planar/flat surface 517. As derivable from FIG. 8, the center of gravity 1200 is above the axis of rotation 1100, and, thus, toothbrush 100 is in an instable/unbalanced position. To prevent the toothbrush 1000 from tipping/rotating to the side if the brush 1000 is moved out of the balanced position, additional geometrical structures in the form of roll stops 1300 are provided.

Figure 10:
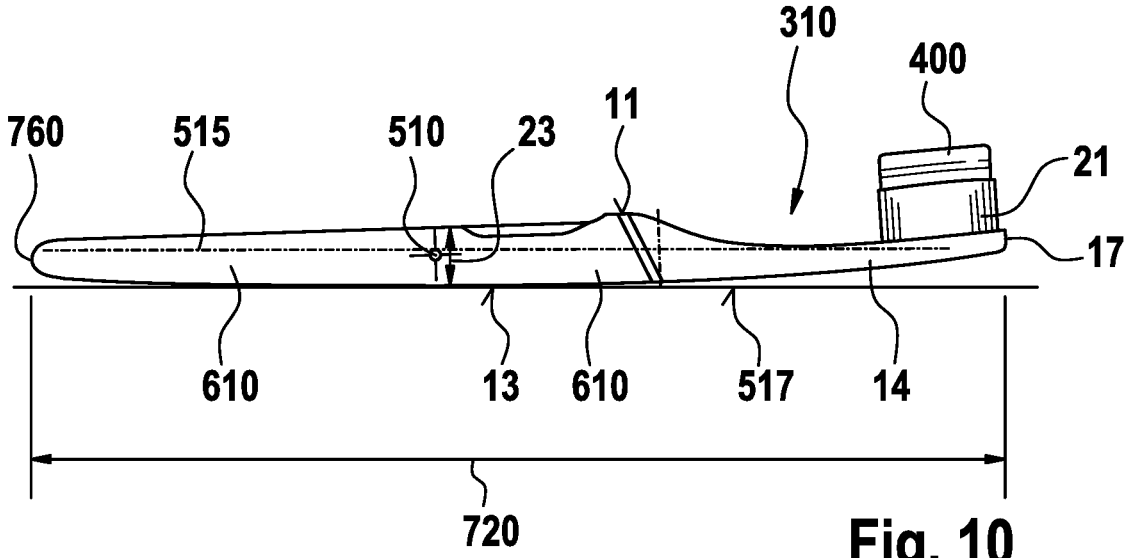
FIG. 10 shows a side view of an example embodiment of an oral care implement according to the present disclosure.

In contrast to the toothbrushes of the state of the art having a lightweight handle, toothbrush 310 according to the present disclosure has a center of gravity 510 being located below the axis of rotation 515 when the brush is loaded with about 1.4 g of toothpaste and placed on a substantially planer/flat surface 517 (cf. FIG. 10). As the center of gravity 510 is closer to the back side 13 than to the front side 11 of toothbrush 310 when measured along the height extension 23 of handle 610, toothbrush 310 returns automatically to an upright position (as shown in FIG. 10) and keeps toothpaste 400 away from the surface 517 once the brush 310 is moved out of the balanced position.

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. An oral care implement having an overall length extension extending between a proximal end and a distal end opposite to the proximal end, the oral care implement comprising a head made of a non-magnetic and/or non-ferromagnetic material and disposed at the proximal end and a handle at least partially made from a material having a density that is higher than the density of the material of the head, the oral care implement having a center of gravity located at a distance measured from the distal end, wherein a ratio of said distance to the overall length extension of the oral care implement is from about 0.30 to about 0.45, wherein the material of the handle comprises a magnetic and/or ferromagnetic material selected from a group consisting of amorphous thermoplastic resin, iron oxide, aluminum oxide, boron nitride, aluminum silicate, and any combination thereof, wherein the magnetic and/or ferromagnetic material of the handle comprises from about 13 weight percent to about 30 weight percent of an amorphous thermoplastic resin; from about 3 weight percent to about 25 weight percent of aluminum oxide, boron nitride, or aluminum silicate; and from about 45 weight percent to about 67 weight percent of iron oxide.

2. The oral care implement of claim 1, wherein the overall length extension of the oral care implement is from about 180 mm to about 220 mm.

3. The oral care implement of claim 1, wherein the oral care implement has a front side and a back side opposite to the front side, and the head has at least one cleaning element extending from the front side, and the handle has a cross-sectional area extending substantially perpendicular to the overall length extension of the oral care implement, the cross-sectional area has a height extension extending between the front side and the back side, and the oral care implement has an axis of rotation when the oral care implement is placed with the back side on a surface, and the center of gravity is below the axis of rotation and closer to the back side than to the front side when measured along the height extension of the handle.

4. The oral care implement of claim 1, wherein the head is at least partially made from a material having a density from about 0.5 g/cm$^3$ to about 1.2 g/cm$^3$, and the handle is at least partially made from a material having a density from about 2.1 g/cm$^3$ to about 3.1 g/cm$^3$.

5. The oral care implement of claim 1, wherein the amorphous thermoplastic resin is selected from the group consisting of: acrylonitrile butadiene styrene, polystyrene, styrene acrylonitrile and any mixture thereof.

6. The oral care implement of claim 1, wherein the magnetic and/or ferromagnetic material comprises about 27.5 weight percent of an amorphous thermoplastic resin, about 17 weight percent of aluminum oxide, about 51 weight percent of iron oxide, and about 4.5% glass fiber.

7. The oral care implement of claim 1, wherein the amorphous thermoplastic resin comprises about 17% weight percent styrene acrylonitrile, and 10.5 weight percent of a blend comprising polybutylene terephthalate and polyethylene terephthalate.

8. The oral care implement of claim 1, wherein the material of the head comprises polypropylene.

9. A kit comprising the oral care implement of claim 1 and a magnetic holder for attaching and holding the oral care implement.

10. A method for manufacturing an oral care implement of claim 1, the method comprising steps:

providing an amorphous thermoplastic resin;

providing aluminum oxide, boron nitride or aluminum silicate;

providing iron oxide;

mixing the amorphous thermoplastic resin, aluminum oxide, boron nitride or aluminum silicate and iron oxide into a magnetic and/or ferromagnetic molding material;

heating the molding material mixture into a flowable molding material;

molding the flowable molding mixture into a handle or part of a handle so that the handle comprises from about 13 weight percent to about 30 weight percent of an amorphous thermoplastic resin, from about 3 weight percent to about 25 weight percent of aluminum oxide, boron nitride, or aluminum silicate, and from about 45 weight percent to about 67 weight percent of iron oxide;

providing a non-magnetic and/or non-ferromagnetic material; and molding the non-magnetic and/or non-ferromagnetic material into a head or part of a head.

11. The method of claim 10, wherein the amorphous thermoplastic resin comprises styrene acrylonitrile, polybutylene terephthalate and/or polyethylene terephthalate.

12. The method of claim 10, wherein at least a portion of the amorphous thermoplastic resin is blended with glass fiber.

13. The method of claim 10, wherein the amorphous thermoplastic resin is provided in a range from about 13 weight percent to about 30 weight percent, the aluminum oxide, boron nitride or aluminum silicate is provided in a range from about 3 weight percent to about 25 weight percent and the iron oxide is provided in a range from about 45 weight percent to about 67 weight percent.

14. The method of claim 10, the method comprising a step of electroplating the handle (12, 600, 610) with a thermoplastic elastomer or a polypropylene material.

15. An oral care implement comprising:

a head made of a non-magnetic and/or non-ferromagnetic material and disposed at the proximal end; and a handle at least partially made from a magnetic and/or ferromagnetic material selected from a group consisting of from about 13 weight percent to about 30 weight percent of an amorphous thermoplastic resin, from about 3 weight percent to about 25 weight percent of aluminum oxide, boron nitride, or aluminum silicate, and from about 45 weight percent to about 67 weight percent of iron oxide.

16. An oral care implement having a proximal end, a distal end opposite to the proximal end, and a length extension extending between the proximal end and the distal end, the oral care implement comprising:

a head made of a non-magnetic and/or non-ferromagnetic material and disposed at the proximal end; and a handle at least partially made from a magnetic and/or ferromagnetic material selected from a group consisting of from about 13 weight percent to about 30 weight percent of an amorphous thermoplastic resin, from about 3 weight percent to about 25 weight percent of aluminum oxide, boron nitride, or aluminum silicate, and from about 45 weight percent to about 67 weight percent of iron oxide, wherein the oral care implement has a center of gravity located at a distance measured from the distal end, and wherein a ratio of said distance to the overall length extension of the oral care implement is from about 0.30 to about 0.45.

* * * * *